United States Patent [19]

Schroder

[11] Patent Number: 4,718,520

[45] Date of Patent: Jan. 12, 1988

[54] GROUP CONTROL FOR ELEVATORS

[75] Inventor: Joris Schroder, Lucerne, Switzerland

[73] Assignee: Inventio AG, Switzerland

[21] Appl. No.: 36,666

[22] Filed: Apr. 8, 1987

[30] Foreign Application Priority Data

Apr. 11, 1986 [CH] Switzerland ..... 01440/86

[51] Int. Cl.[4] ..... B66B 1/18

[52] U.S. Cl. ..... 187/127

[58] Field of Search ..... 187/121, 124, 127, 130

[56] References Cited

U.S. PATENT DOCUMENTS

| | | | |
|---|---|---|---|
| 3,374,864 | 2/1968 | Port | 187/121 |
| 3,493,922 | 2/1970 | Laas | 187/121 |
| 4,411,337 | 10/1983 | Schröder et al. | 187/127 |
| 4,492,288 | 1/1985 | Schröder | 187/127 |
| 4,555,000 | 11/1985 | Umeda | 187/127 |
| 4,638,889 | 1/1987 | Ludwig et al. | 187/127 |

*Primary Examiner*—William M. Shoop, Jr.
*Assistant Examiner*—W. E. Duncanson, Jr.
*Attorney, Agent, or Firm*—Marshall & Melhorn

[57] ABSTRACT

A group control assigns elevator cars to floor calls optimized in such a manner, that minimal waiting times result and the elevating capacity is increased. A computing device provided for each elevator calculates at every floor a sum proportional to the time losses of the waiting passengers from the distance between the floor and the car position as indicated by a selector, the intermediate stops to be expected within the distance and the instantaneous car load. By means of call registering devices in the form of ten key keyboards at the floors, it is possible to enter calls for destination floors, so that at the time of calculation, the floor calls and the car calls are available simultaneously. The calculated lost time sum, also called servicing costs, is stored in a cost memory provided for each elevator. During a cost comparison cycle, the servicing costs of all elevators are compared with each other by way of a cost comparison device where in each case an assignment instruction can be stored in an assignment memory of the elevator with the lowest servicing costs which instruction designates that floor to which the respective car is optimally assigned in time.

7 Claims, 6 Drawing Figures

GROUP CONTROL FOR ELEVATORS

BACKGROUND OF THE INVENTION

The invention relates in general to a group control for elevators and, in particular, to a control for entering car calls at the floors.

In a group control of the type disclosed in the European Pat. No. B-032,213, the assignments of the cars can be optimized in time. A sum proportional to the lost time of waiting passengers and the lost time of the passengers in the car is calculated by means of a computer in the form of a microprocessor during a scanning cycle of a first scanner device at every floor, whether a floor call is present or not. The sum is based upon the distance between the floor and the car position indicated by a selector, the intermediate stops to be expected within this distance and the momentary car load.

In this case, the car load present at the moment of calculation is corrected in such a manner, that the probable number of entering and exiting passengers, derived from the entering and existing passenger numbers in the past, can be considered at future intermediate stops. This sum of lost time, also called cost of operation, is stored in a cost memory or register. During a cost comparison cycle by means of a second scanner of the scanning device, the operating costs of all elevators are compared to each other by way of a cost comparison device. In each case, an assignment instruction is stored in an assignment register of the elevator with the lowest operating costs, which assignment designates that floor to which the corresponding car has optimally been assigned in time.

The intermediate stops required for the calculation of the operating costs are generated from the entered floor and car calls. Since the floor and car calls are customarily entered by means of call buttons arranged at the floors and in the car respectively, a passenger has to select twice in order to reach a destination. In the case of an occupied car, the access to the car keyboard is often rendered difficult. Under these circumstances, the control device obtains information about the desired destination relatively late, which for this reason cannot be taken into account for the optimization of the assignment.

U.S. Pat. No. 3,374,864 discloses a group control in which the desired floor of destination can be entered at the floor of entry. For this purpose, call buttons for every floor are arranged at the floor, while no call buttons are arranged in the car. The control operates in a manner such that the car destined for a destination floor makes known the floor of destination at the arrival at the floor of entry by an optical indicating device so that passengers who would like to travel to other floors do not erroneously enter. In this group control, the destination floor call entry is not utilized for the timely optimal assignment of a car call, but it is intended to avoid unnecessary travels caused by wrongly entered directional calls and stops, and to prevent unwanted transportation of passengers in the wrong direction. The arrangement of call buttons for every floor at every floor provided in this group control would increase the cost considerably in the case of larger installations with many floors and would also lead to call button placement problems.

SUMMARY OF THE INVENTION

The present invention concerns a group elevator control in which the optimization in time of the assignments of cars to calls is improved in comparison to the prior art and where the disadvantages of the prior art are avoided.

The invention includes a call memory or register device having call buttons in the shape of a ten key keyboard located at every floor, where calls for the desired destination floors can be entered by means of the call buttons. The call registers are connected with the floor call memory and the car call memory, where in the presence of at least one call registered by a call register device, a call is registered in the floor call memory for the floor associated with the respective call register device. The car call memory consists of a first memory containing already assigned car calls and further memories assigned to the floors in which the calls, entered at the respective floors for desired destination floors, but not yet assigned to a car, are stored but considered in the calculation of the operating costs. The first memory, the further memories, the floor call memory and the assignment memory are linked to each other by means of a coincidence circuit, such that on assignment of a floor call, the calls stored in the assigned further memory are transferred into the first memory.

The advantages realized by the invention are, that the complete passenger data is available earlier to the control, so that optimization of the car/call assignments is improved, with the waiting times becoming shorter and the conveying capacity increasing. Further advantages are realized by the fact, that the passengers have to press call buttons only once and that the difficulties often arising during the entering of calls in the car do not occur. Due to the missing keyboard in the car, less conductors are required in the suspension cable. Use of a ten key keyboard is also advantageous, as thereby, especially in installations with many floors, conductors can be saved, as well as making possible standardization of the floor keyboard.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
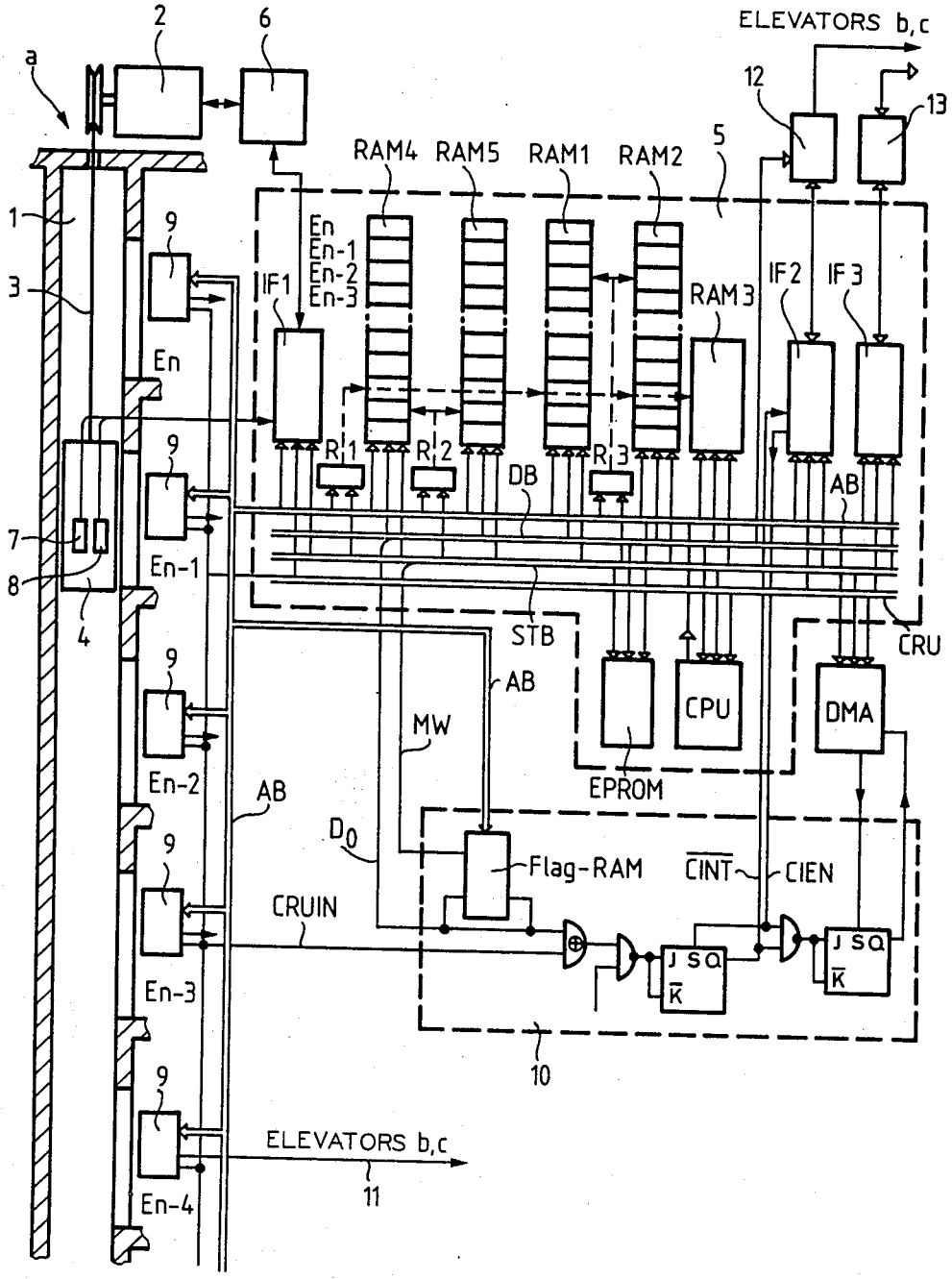
FIG. 1 is a schematic representation of a group control according to the invention for an elevator of a three elevator group.

There is shown in FIG. 1 an elevator shaft for an elevator "a" of an elevator group consisting, for example, of three elevators "a", "b" and "c". By way of a hoisting cable 3, a hoist 2 drives a car 4 guided in the elevator shaft 1, with "n" floors E0 to En being serviced, of which only the uppermost floors En-4 to En are shown. The hoist 2 is controlled by a drive control 6 disclosed in the European Pat. No. B-026,406 where the generation of the set point, the control functions and the stop initialization are realized by means of a microcomputer system 5, and where the metering and final control elements of the drive control 6 are connected to the microcomputer system 5 by way of an interface IF1.

The car 4 includes a load measuring device 7 and a device 8 signaling the momentary operating condition Z of the car, which devices are likewise connected with the microcomputer system 5 by way of the first interface IF1. Provided on the floors are call registering devices 9, described in more detail with the aid of FIGS. 2 and 3, by means of which calls for travels to desired destination floors can be entered. The call registering devices 9 are connected by an address bus AB and a data input conductor CRUIN of a serial input-/output bus CRU with the microcomputer system 5 and an input device consisting of a comparison device 10 and a DMA-building block DMA as disclosed in the European Pat. No. B-062,141. The call registering devices 9 are further connected through conductors 11 with the microcomputer systems and input devices of the elevators "b" and "c".

The microcomputer system 5 includes a floor call memory RAM1, a car call memory RAM2, to be explained in more detail in the following with the aid of FIG. 4, a memory RAM3 storing the momentary car load $P_M$ and the operating condition Z of the car 4, one cost memory RAM4 for each of the upward and downward travel directions, an assignment memory RAM5 for each of the upward and downward travel directions, a program memory EPROM and a microprocessor CPU. The microprocessor is connected by way of the address bus AB, a data bus DB and a control bus STB with the registers RAM1 to RAM5 and the EPROM. A first and a second scanner of a scanning device are designated by R1 and R2, where the scanners R1 and R2 are registers by which addresses corresponding to the floor numbers and the travel directions are formed. A selector in the form of a further register is designated R3, which with a traveling car indicates the address of that floor at which the car could still stop. As known from the previously cited drive control, destination paths are assigned to the selector addresses, which are compared with a destination path generated in a set point emitter. At equality of the paths and the presence of a stop command, the stop phase is initiated. If a stop command does not exist, the selector R3 is switched to the next floor.

The microcomputer systems 5 of the individual elevators "a", "b" and "c" are connected to each other by way of a cost comparison device 12 known from the European Pat. No. B-050,304 and a second interface IF2, as well as through a partyline transfer system 13 known from the European Pat. No. B-050,305 and a third interface IF3, and form in this way the group control according to the invention.

Figure 2:
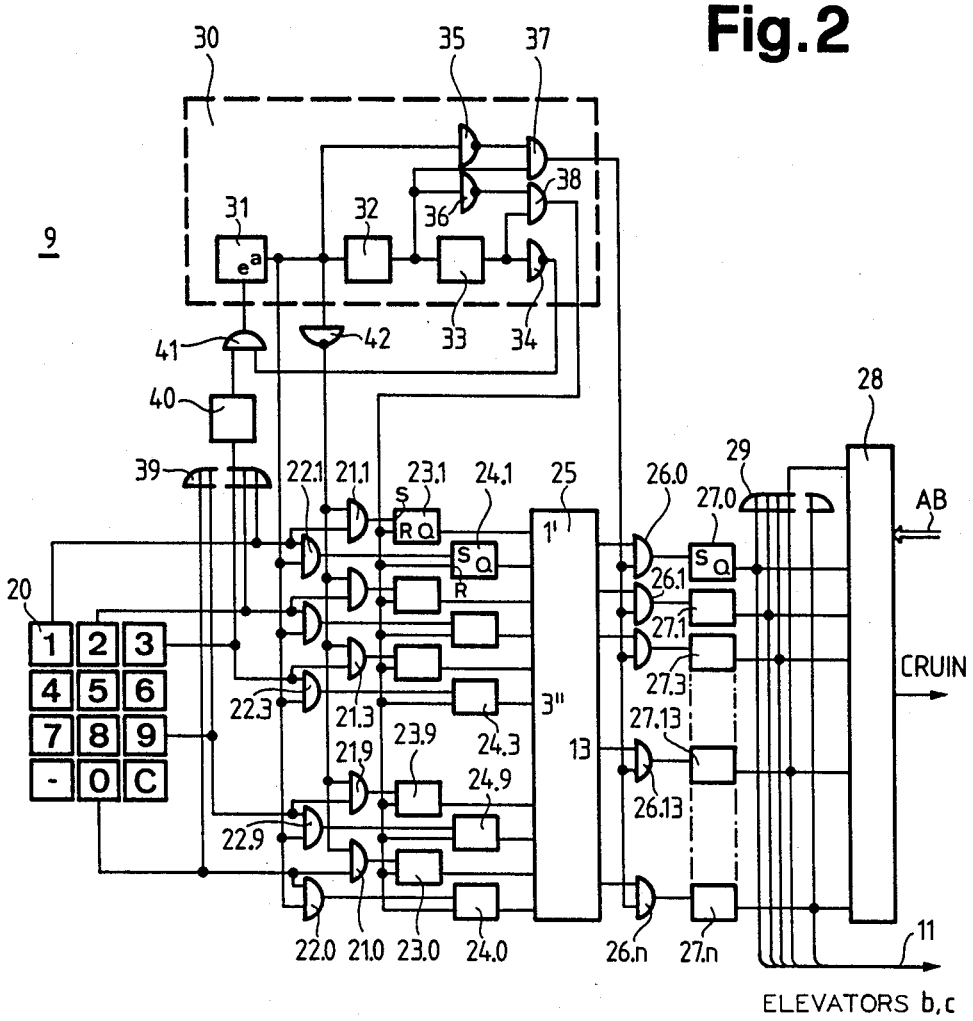
FIG. 2 is a circuit diagram of a call memory device of the group control according to FIG. 1.

In FIG. 2, the call registering device 9, arranged for example for one and two digit calls, consists of a keyboard 20, which exhibits ten keys for the numerals one through nine and zero for entering the input to desired destination floors. An eleventh key designated with "—" can be used for instance as a preselector key in calls for floors lying below the ground floor, where the ground floor is characterized by the numeral zero. A twelfth key designated with "C" could have further uses such as for instance as a preselector key for the coded input of calls. The keys of the numerals are connected to first inputs of first AND-gates 21.0 through 21.9, the outputs of which are connected with inputs S of key registers 23.0 through 23.9, for the storage of an earlier entered numeral.

The keys of the numerals are connected furthermore with the first inputs of second AND-gates 22.0 through 22.9, the outputs of which are in connection with inputs S of key registers 24.0 through 24.9, for the storage of a second entered numeral. For example, RS-flip flops can be used as key registers. The outputs Q of all key registers are connected with the inputs of a combinatorial logic circuit 25, the outputs of which are connected to first inputs of third AND-gates 26.0 through 26.*n*, which on their output side are in connection with inputs S of all memories 27.0 through 27.*n* in the form of, for example, RS-flip flops, assigned to the floors.

The combinatorial logic circuit 25 operates in such a manner, that on input of a single digit call, one of the call registers 27.0 through 27.9, assigned to the floors E0 through E9, is set and on input of a two digit call, one of the call registers 27.10 through 27.*n* assigned to the floors E10 through En, is set. If, for example, calls for the floors E1 and E13 are entered, the combinatorial logic 25 has to fulfill the equations:

$$1 = 1' \wedge \overline{2'} \wedge \overline{3'} \ldots \overline{9'} \wedge \overline{0'} \wedge \overline{1''} \wedge \overline{2''} \ldots \overline{9''} \wedge \overline{0''}$$

$$13 = \overline{1'} \wedge \overline{2'} \wedge \overline{3'} \ldots \overline{9'} \wedge \overline{0'} \wedge \overline{1''} \wedge \overline{2''} \wedge \overline{3''} \ldots \overline{9''} \wedge \overline{0''}$$

where the input variables 1', 2', 3' . . . signify the first entered numeral and 1", 2", 3" . . . the second entered numeral, and the output variables "1" and "13" designate the selected destination floors E1 and E13.

The outputs Q of the call memories 27.0 through 27.*n* are connected with the inputs of a multiplexer 28 and an OR-gate 29, the output of which is connected to the first input of the multiplexer 28. The multiplexer 28 is also connected with the address bus AB and is connected on its output side to the data input conductor CRUIN. The outputs Q of the call memories 27.0 through 27.*n* also are connected by way of the conductors 11 with the multiplexers 28 and OR-gates 29 of the elevators "b" and "c".

A time limiting circuit 30 for the call input consists of a monoflop 31, a first and a second delay element 32 and 33, a first, second and third NOT-gate 34, 35 and 36, and a first and second AND-gate 37 and 38. The numeral keys are connected, by way of an OR-gate 39, a further delay element 40 and a further AND-gate 41 with the input "e" of the monoflop 31. The output "a" of the monoflop 31 is connected to the input of the first delay element 32, to the second inputs of the second AND-gates 22.0 through 22.9, and by way of a further NOT-gate 42 to the second inputs of the first AND-gates 21.0 through 21.9. The output of the first delay element 32 is connected with the input of the second delay element 33, the output of which is connected by way of the first NOT-gate 34 to the second input of the AND-gate 41. It is, for example, possible to use series connected logic units as delay elements where the delay time results from the signal running time.

The output "a" of the monoflop 31 is connected by way of the second NOT-gate 35 with the first input of the first AND-gate 37. The second input of AND-gate 37 is connected to the output of the first delay element 32 and the output is connected to the second inputs of the third AND-gates 26.0 through 26.*n*, which are connected in series with the call memories 27.0 through 27.*n*. The output of the first delay element 32 is connected by way of the third NOT-gate 36 with an input of the second AND-gate 38, the second input of which is connected to the output of the second delay element 33 and the output of which is connected to the reset input R of each of the key registers 23.0 through 23.9.

The call memory device 9 operates as follows: on input of a call, for example to floor E13, first the key of the numeral one is activated and a short pulse is generated. Since the first AND-gates 21.0 through 21.9 are released by way of the NOT-gate 42, only the key register 23.1 is set (point in time I, signal Ruf, FIG. 3). After a delay caused by the delay element 40, the monoflop 31 is switched so that the output of the NOT-gate 42 is set low and the first AND-gates 21.0 through 21.9, assigned to the key registers 23.0 through 23.9 for the input of the first numeral, are inhibited (point in time II, FIG. 3). Simultaneously, the second AND-gates 22.0 through 22.9, assigned to the key registers 24.0 through 24.9, for the input of the second numeral, are released. It shall now be assumed, that the switching-on time of the monoflop 31 is, for example, one second and the key of the numeral three is still actuated during this time. Thus, the key register 24.3 is set, so that the combinatorial logic circuit 25 exhibits the input variables (1' and 3") and the output variable (13) assigned to the call register 27.13 for the floor E13.

Figure 3:
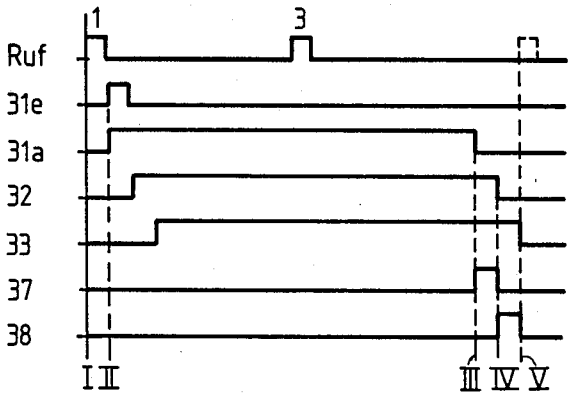
FIG. 3 is a diagram of the time sequence of call registering for the circuit of FIG. 2.

The downwardly sloping sides of the output pulses of the monoflop 31 and of the first delay element 32 generate a pulse at the output of the first AND-gate 37, by means of which the third AND-gates 26.0 through 26.*n* are released and the call memory 27.13 assigned to the floor E13 is set (point in time III, FIG. 3). Likewise, a further pulse is generated by the downwardly sloping sides of the output signals of the first and second delay elements 32 and 33 at the output of the second AND-gate 38, by means of which pulse all the key registers are reset (point in time IV, FIG. 3). The downwardly sloping side of the pulse from the second delay element 33 releases the monoflop 31 by way of the first NOT-gate 34 and the AND-gate 41, so that a further call can be entered (point in time V, FIG. 3).

The call memories 27.0 through 27.*n* can be scanned by way of the multiplexer 28 and stored calls transferred into the microcomputer system 5 of the corresponding elevator. THe first input of the multiplexer 28 is activated through the OR-gate 29 at the presence of at least one call and the assigned address interpreted as the address of a floor call. The addresses assigned to the remaining inputs of the multiplexer 28 are interpreted as addresses of car calls, where for example a first part of the address designated the destination floor, and a second part of the address serves as a selection code of the corresponding multiplexer and designates that floor at which the call for the destination floor was entered.

As known from the European Pat. No. B-062,141 mentioned in the description in FIG. 1, the transfer of the calls into the microcomputer system 5 takes place in such a manner that the microprocessor CPU signals, by an enabling signal CIEN, its readiness for the acceptance of interrupt requests $\overline{\text{CINT}}$. The enabling signal CIEN activates the DMA-unit which takes over the control of the address bus AB and the serial input/output bus CRU. The addresses generated by the DMA-unit interrogate the call registers 27.0 through 27.*n* of the call register devices 9 and a read-write memory Flag-RAM of the comparator circuit 10. In the comparator circuit 10, the contents of the call memories 27.0 through 27.*n* and of the assigned memory locations of the read-write memory Flag-RAM are compared to each other. At inequality, the DMA-operation is terminated and an interrupt request CINT generated. The microprocessor CPU now carries out an interrupt program, where it reads the data bit present on the data input conductor CRUIN and writes it under the address existing on the address bus AB into the floor call memory RAM1 or into the car call memory RAM2 and, by way of a data conductor $D_O$ of the data bus DB, into the read-write memory Flag-RAM.

Figure 4:
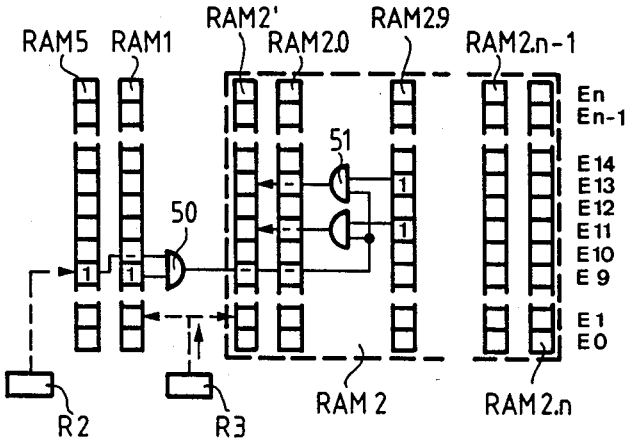
FIG. 4 is a schematic representation of the structure of a car call memory assigned to an elevator of the group control according to FIG. 1 and a coincidence circuit for the call assignment.

As shown in FIG. 4, the car call memory RAM2 consists of a first memory RAM2', which includes memory locations corresponding to the number of floors, and in which already assigned calls are stored. Further memories assigned to the floors EO, E1 . . . En are labled by RAM2.0, RAM2.1. . . . RAM2.*n*, which include storage locations corresponding to the number of the floors. Into the further memories RAM2.0 through RAM2.*n*, only the calls entered at the respective floors are transferred, by means of the process described in the preceding section, which are not yet assigned to any specific car. The first memory RAM2', the further memories RAM2.0 through RAM2.*n*, the floor call memory RAM1 and the assignment memory RAM5 are linked with each other by way of a coincidence circuit symbolized by AND-gates 50 and 51. The coincidence circuit is formed by the microprocessor CPU based on a program at every position of the second scanner R2, and has the effect, that on coincidence of an assignment instruction and a floor call at the same floor, the calls stored in the assigned further memory are transferred into the first memory RAM2', whereby they are assigned and released for the scanning by the selector R3. According to the example illustrated, only the assignment memory RAM5 for the upward travel direction is shown in FIG. 4.

Figure 5:
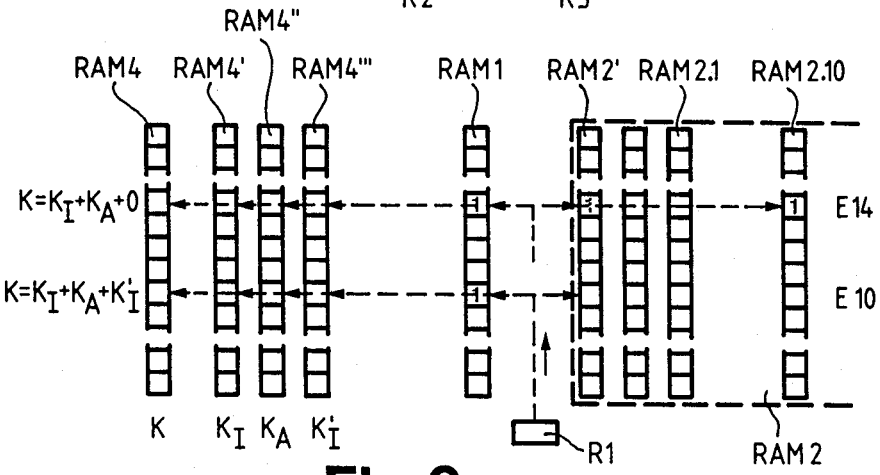
FIG. 5 is a schematic representation for the visualization of an operating cost calculation according to the invention based on the call assignment for an elevator.

Designated with RAM4', RAM4" and RAM4"' in FIG. 5 are cost share memories, in which, as explained in more detail in the following, operating cost shares $K_I$, $K_A$ and $K_I'$ stored. The cost share memories, the cost memory RAM4, the floor call memory RAM1, and the car call memory RAM2 are linked with each other at every floor position of the first scanner R1. The linkage necessary for the operation described in more detail in the following is carried out by the microprocessor CPU based on a program. Only the cost memory RAM4 and the cost share memories RAM4', RAM4" and RAM4"' for the upward travel direction are illustrated in FIG. 5.

The assignment of a floor call and of the calls entered at a floor for desired destination floors takes place in a manner similar to that in the European Pat. No. B-032,312 previously mentioned and will be explained in more detail with the aid of FIGS. 4, 5 and 6. On input of a call, the first scanners R1 of the elevators "a", "b"

and "c" start with a cycle, called cost calculating cycle KBZ in the following, proceeding from the selector position in the direction of travel (point in time I, FIG. 6). During the cost calculating cycle KBZ, operating costs E are calculated by the microprocessor system 5 at every scanner position according to the equation $$K=t_v(P_M+k_1 R_E-k_2 R_C)+k_1[m\ t_m+t_v(R_E+R_C-R_{EC}+Z)] \quad \text{equation one}$$

where $t_v$ is the delay time at an intermediate stop, $P_M$ is the instantaneous load at the time of calculation, $R_E$ is the number of assigned floor calls between selector and scanner position, $R_C$ is the number of car calls between selector and scanner position, $k_1$ is an expected number of entering passengers per floor call determined as a function of the traffic conditions, $k_2$ is an expected number of leaving passengers per car call determined as a function of the traffic conditions, m is the number of floor distances between selector and scanner positions, $t_m$ is the mean time of travel per floor distance, $R_{EC}$ is the number of coincidences of car calls and assigned floor calls between selector and scanner position, Z is an increase dependent on the operating condition of the car, $K_I$ is $t_v(P_M+k_1 \cdot R_E-k_2 \cdot R_C)$ the internal servicing costs and $K_A$ is $k_1[m \cdot t_m+t_v(R_e+R_C-R_{EC}+Z)]$ the external servicing costs.

The servicing costs $K_I$ and $K_A$ determined according to the preceding equation are stored in the cost memory RAM4, respectively in the cost share memories RAM4' and RAM4''. If a car call $R_C$ is present in the corresponding scanner position at the time of calculation, the servicing costs K to be stored are reduced by setting the internal servicing costs $K_I$ equal to zero. By the formation of a new address, the scanner R1 is switched to the next floor and a new calculation carried out.

If the scanners R1, during cost calculating cycle KBZ, encounter a not yet assigned floor call, for example at floor E10 in FIG. 5, and if a call is stored in the assigned further memory RAM2.10, for example for floor E14, the additional internal servicing costs $K'_I$ caused by this call are also taken into account according to the equations, $$K=K_I+K_A+K'_I \text{ and} \quad \text{equation two}$$

$$K'_I=t_v(P'_M+k_1 \cdot R'_E-k_2 \cdot R'_C) \quad \text{equation three}$$

where $P'_M$ is the expected load resulting from the relationship $t_v \cdot P'_M=K_I$ on reaching the assigned floor call, $R'_E$ is the number of assigned floor calls between entering and destination floors of the not yet assigned call, $R'_C$ is the number of car calls between entering and destination floors of the not yet assigned call, and where the additional internal servicing costs $K'_I$ determined according to equation three are stored in the cost share memory RAM4'''.

Since it is assumed, according to the example, that the scanning by means of the scanners R1 takes place in an upward direction and on reaching the scanner position E10, a not yet assigned floor call is stored in the further memory RAM2.10 for the floor E14, an upward call, the servicing costs K are stored in the cost memory RAM4 assigned to the upward travel direction. If for instance, a car call already assigned to elevator "a" is stored simultaneously for floor E10, then the internal servicing costs $K_I$ for the floor E10 are not considered in the addition according to the preceding equation two. By reducing the servicing costs K in this way, the assignment of the floor call E10 to the elevator "a" becomes more probable, so that the strived for objective, to save time at the same stop by entering and exiting passengers, can more likely be attained.

If furthermore, a floor or car call already assigned to the elevator "a" is stored simultaneously for floor E14 (FIG. 5), then the additional internal servicing costs $K'_I$ caused by the stored call for floor E14 in the memory RAM2.10, are not considered in the calculation of this scanner position according to preceding equation two.

Figure 6:
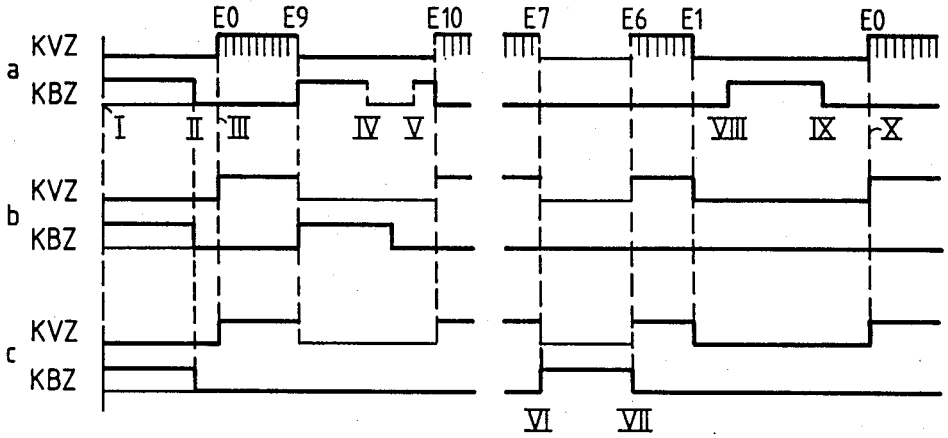
FIG. 6 is a diagram of the time sequence of operating cost calculations for the group control according to FIG. 1.

After termination of the cost calculating cycle KBZ (point in time II, FIG. 6), the scanners R2 simultaneously start a cycle on all elevators "a", "b" and "c" in a cost comparison cycle KVZ, beginning from floor E0 (point in time III, FIG. 6). The start of the cost comparison cycles KVZ takes place, for example, from five to ten times per second. At each scanner position, the servicing costs K contained in the cost memories RAM4 of the elevators are supplied to the cost comparison device 12 and compared with each other. In each case, the one of the elevators "a", "b", and "c" with the lowest servicing costs K has its assignment memory RAM5 in which an assignment instruction can be stored in the form of a logic "1", which indicates the floor to which the respective elevator has been assigned optimally in time. For example, let a new assignment take place based on comparison in the scanner position E9 by cancellation of an assignment instruction for elevator "b" and entry of one for elevator "a" (FIG. 4). By the new assignment in scanner position E9, a new cost calculation cycle KBZ is started for each of the elevators "a" and "b" and the cost comparison cycle KVZ interrupted, since the KBZ cycle has priority.

According to FIG. 4, a call is stored in the floor call memory RAM1 for floor E9, so that by activation of the AND-gates 51 of the coincidence circuit, the calls stored in the assigned memory RAM2.9, for example, for the floors E11 and E13 are transferred into the first memory RAM2' of the car call memory RAM2, and thereby are likewise assigned to the elevator "a". During the new cost calculating cycle KBZ, these calls are now considered as car calls $R_C$ (E11 and E13) and as floor call $R_E$ (E9) in the equation one. On switching of the selector R3 and arriving at the scanner position E9, it is established that the assignment instruction is stored in the assignment memory RAM5 assigned to the upward travel direction, so that calls for the floors E9, E11 and E13 have to be serviced by the elevator "a", which according to the example is in the process of upward travel. After the switching of the selector R3 into the scanner position E9, the slow down phase is initiated and the car 4 of the elevator "a" is brought to a stop at floor E9. If during the slow down phase on floor E9, further calls are entered for destination floors lying in the continued travel direction of car 4, the microprocessor CPU of the elevator "a" causes, after entry of those calls into the memory RAM2.9, the immediate transfer of those calls into the first memory RAM1', whereby they are assigned to the elevator "a" without the assignment procedure described in the preceding.

While the cost calculation cycle KBZ of elevator "b", in continuation of the example according to FIG. 6, proceeds without interruption, the cost calculation cycle of elevator "a" between the points in time IV and V stops on account of a drive control event. Subsequently the cost comparison, starting with scanner position E10, is continued in order to be interrupted again at scanner position E7 (downward) by the occurrence of an event at elevator "c", for instance a change in the selector position (point in time VI). After termination of the cost calculation cycle KBZ triggered by this event on elevator "c" (point in time VII), there follows the continuation of the cost comparison cycle KVZ and its termination at the scanner position E1 (downward). Between the points in time VIII and IX there is a further cost calculation cycle KBZ for elevator "a", whereupon the next cost comparison cycle KVZ is started at point in time X.

On arrival at a floor of a car destined for one or several destination floors, it is made known to the passengers waiting at this floor by a suitable indicating device, not illustrated, whether the desired destination can be reached with the arriving car.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a group control for elevators with call registering devices at each floor and load measuring devices provided in the cars of the elevator group, with selectors assigned to every elevator of the group indicating in each case the floor of a possible stop, with a scanning device having at least one position for every floor, and with a control device, by means of which the calls entered at the floors are assigned to the cars of the elevator group, where the control device per elevator includes a computing device, a floor call memory and a car call memory, and where the computing device at every position of a first scanner of the scanning device calculates the servicing costs K corresponding to the waiting times of the passengers according to the equation $$K=t_v(P_M+k_1\cdot R_E-k_2\cdot R_C)+k_1[m\cdot t_m+t_v(R_E+R_C-R_{EC}+Z)]$$

where $t_v(P_M+k_1\cdot R_E-k_2\cdot R_C)$ is the internal servicing cost $K_I$ and $k_1[m\cdot t_m+t_v(R_E+R_C-R_{EC}+Z]$ is the external servicing cost $K_A$ and further including a cost memory for storing the servicing costs K, a pair of cost share memories for storing the internal and external servicing costs $K_I$ and $K_A$ respectively, a cost comparison device for determining the car with the lowest servicing costs K at every position of a second scanner of the scanning device and an assignment memory, where an assignment instruction for a floor call of the respective scanner position can be written into the assignment memory of the car exhibiting the lowest servicing costs K, the improvement comprising:

a call registering device having call buttons in the form of a ten key keyboard and a plurality of call memories corresponding to the number of floors to be served for storing calls for desired destination floors entered in response to actuation of said call buttons;

said call memories being connected with a floor call memory and a car call memory where in response to the presence of at least one call in said floor call memory, registered by said call registering device, a call is stored for the floor specified by said call registering device;

said car call memory including a first memory containing assigned car calls and further memories for storing the car calls which are entered at the respective floors for desired destination floors, but not yet assigned to a car, which car calls are considered in the calculation of the servicing costs K of the scanner position assignment to the respective floor; and said first memory, said further memories, said floor call memory and said assignment memory are connected by means of a coincidence circuit whereby on assignment of a floor call, the car calls stored in said further memories are transferred into said first memory.

2. The group control according to claim 1 wherein the computing device in the presence of a not yet assigned floor call calculates the servicing costs K of the corresponding scanner position according to the equation $$K=K_I+K_A+K'_I$$

and where $K'_I=t_v(P'_M+k_1\cdot R'_E-k_2\cdot R'_C)$ is an additional internal servicing cost.

3. The group control according to claim 2 including a third cost share memory in which said additional internal servicing costs $K'_I$ are stored, and wherein said third cost share memory, said pair of cost share memories storing the internal and external servicing costs $K_I$ and $K_A$, the cost memory, the floor call memory and the car call memory are connected with each other in such a manner, that in the presence of an assigned floor call or car call and a not yet assigned car call at the same scanner position, the servicing costs K to be stored in the cost memory are not increased by the additional internal servicing cost $K'_I$.

4. The group control according to claim 1, wherein keys corresponding to the numerals zero through nine of said ten key keyboard are connected with associated first key memories for the storage of a first entered numeral and with associated second key memories for the storage of a second entered numeral; outputs of all said key memories are connected with inputs of a combinatorial logic device with outputs connected through AND-gates with inputs of said call memories; and including a time limiting circuit connected on its input side with said keys of the numerals zero through nine and on its output side with reset connections of all said key memories, as well as through said AND-gates to inputs of said call memories, whereby through the input of a numeral by one of said keys, said time limiting circuit is activated during a predetermined time for the input of a second numeral, and after expiration of this time, a call memory assigned to the first numeral and any second numeral is set and all said key memories are reset.

5. The group control according to claim 4 wherein said predetermined time provided for the input of a second numeral is approximately one second.

6. The group control according to claim 4 wherein said time limiting circuit includes a monoflop device, a first and second delay element, a first, second and third NOT-gate, and a first and second AND-gate each having two inputs; an input of said monoflop is connected through a third AND-gate having two inputs, a third delay element and an OR-gate to said keys of the numerals zero through nine; an output of said monoflop is connected to an input of said first delay element and through said second NOT-gate to one input of said first AND-gate, a second input of which is in connection with an output of said first delay element and an output of which is in connection with inputs of said AND-gates connected in series with said call memories; said output of the first delay element is connected with an input of said second delay element and through said third NOT-gate to an input of said second AND-gate, a second input of which is connected to an output of said second delay element and an output of which is connected to reset inputs of all said key memories, and said output of said second delay element is connected to said first NOT-gate and to an input of said third AND-gate.

7. The group control according to claim 1 wherein outputs of said call memories are connected to data inputs of a multiplexer and to inputs of an OR-gate, an output of which is connected to a first data input of said multiplexer, and address inputs of said multiplexer are connected with an address bus of the control device, whereby the address assigned to the first data input is interpreted by the control device as the address of a floor call and the addresses assigned to the remaining data inputs are interpreted as addresses of car calls.

* * * * *